US006408765B1

(12) United States Patent
Tauber et al.

(10) Patent No.: US 6,408,765 B1
(45) Date of Patent: Jun. 25, 2002

(54) DOOR BREACHING DEVICE WITH SAFETY ADAPTER

(75) Inventors: Zvi Tauber, Kiryat Motzkin; Joseph Teper, Kiryat Bialik, both of (IL)

(73) Assignee: State of Israel-Ministry of Defense Armament Development Authority-Rafael, Haifa (IL)

( * ) Notice: Subject to any disclaimer, the term of this patent is extended or adjusted under 35 U.S.C. 154(b) by 0 days.

(21) Appl. No.: 09/260,034

(22) Filed: Mar. 2, 1999

(51) Int. Cl.[7] ..... F42B 3/00; F42B 5/04; F42B 7/00

(52) U.S. Cl. ..... 102/499; 102/275.3; 102/275.7; 102/487; 102/484; 102/485; 102/482

(58) Field of Search ..... 102/275.3, 275.7, 102/275.12, 277.1, 484, 485, 499, 482, 487, 397

(56) References Cited

U.S. PATENT DOCUMENTS 3,726,036 A * 4/1973 Jennings et al. ..... 42/1 F
4,747,349 A * 5/1988 Schilling et al. ..... 102/485
4,793,259 A * 12/1988 Ambrosi et al. ..... 102/485
4,815,382 A * 3/1989 Yunan ..... 102/275.7
4,920,886 A * 5/1990 Gabriels ..... 102/476
5,198,615 A * 3/1993 Robbie et al. ..... 102/476
5,327,835 A * 7/1994 Adams et al. ..... 102/275.11
5,349,906 A * 9/1994 Devaux et al. ..... 102/485
5,377,438 A * 1/1995 Sheinfeld et al. ..... 42/96
5,417,162 A * 5/1995 Adams et al. ..... 102/317

* cited by examiner

*Primary Examiner*—Charles T. Jordan
*Assistant Examiner*—Lulit Semunegus
(74) *Attorney, Agent, or Firm*—Mark M. Friedman

(57) ABSTRACT

A breaching device for controlled blasting of an object at short range includes a blasting element including an explosive charge contained within a housing, the blasting element being configured to blast the object from a preset distance. Connected to, and extending from, the housing is a stand-off rod having a length equal to the preset distance. A pyrotechnic lead pellet is associated with the blasting element and with the stand-off rod so as to detonate the explosive charge upon impact of the stand-off rod with the object. A tail is provided for stabilizing the device during its flight to the object. The tail is connected to the blasting element through a "safe and arm" device and a safety connector configured to reduce shock forces acting on the tail resulting from detonation of the explosive charge.

16 Claims, 5 Drawing Sheets

DOOR BLASTING RIFILE GRANADE

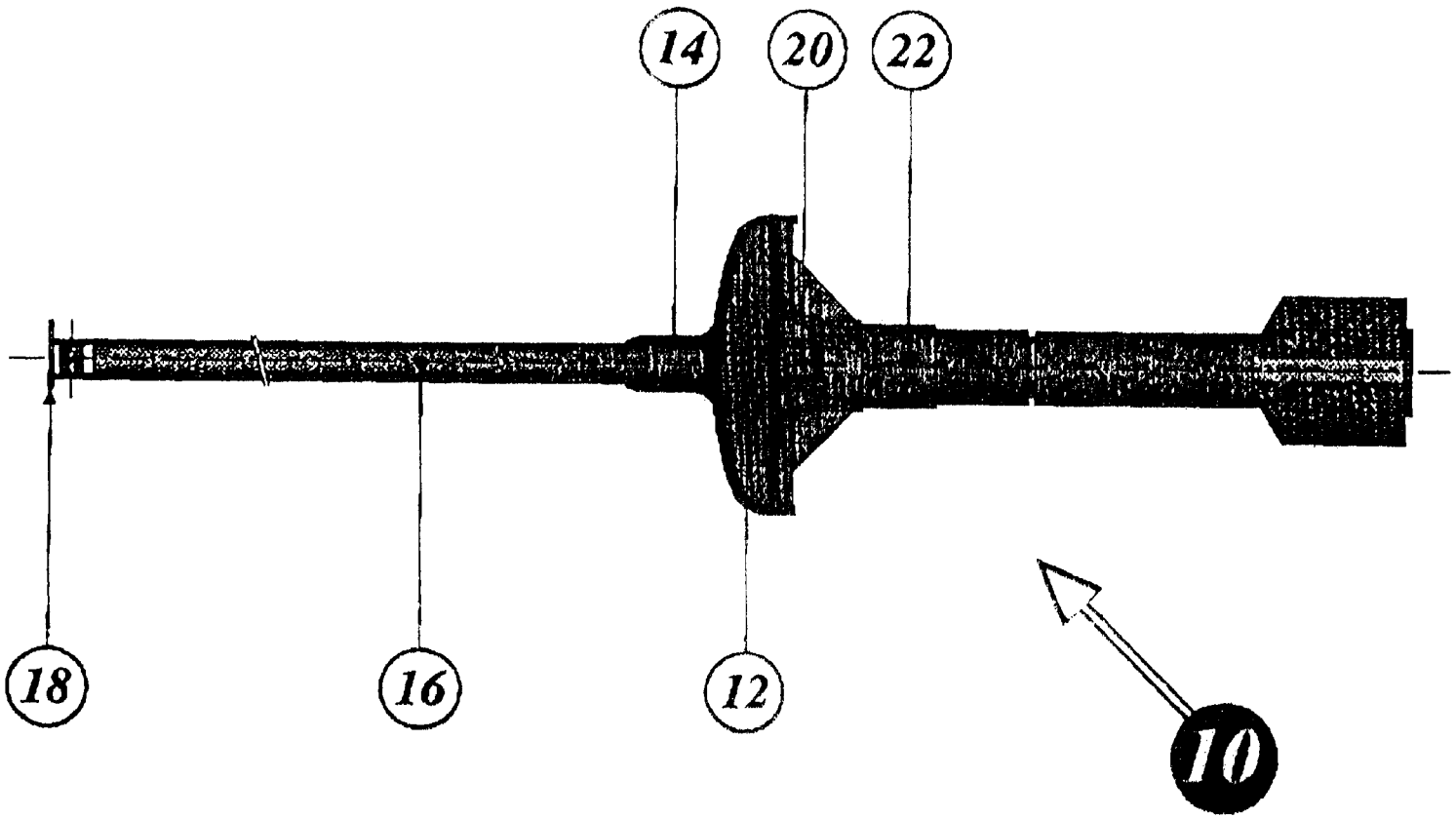
Fig.1 - PRIOR ART

Fig.2 - DOOR BLASTING RIFILE GRANADE
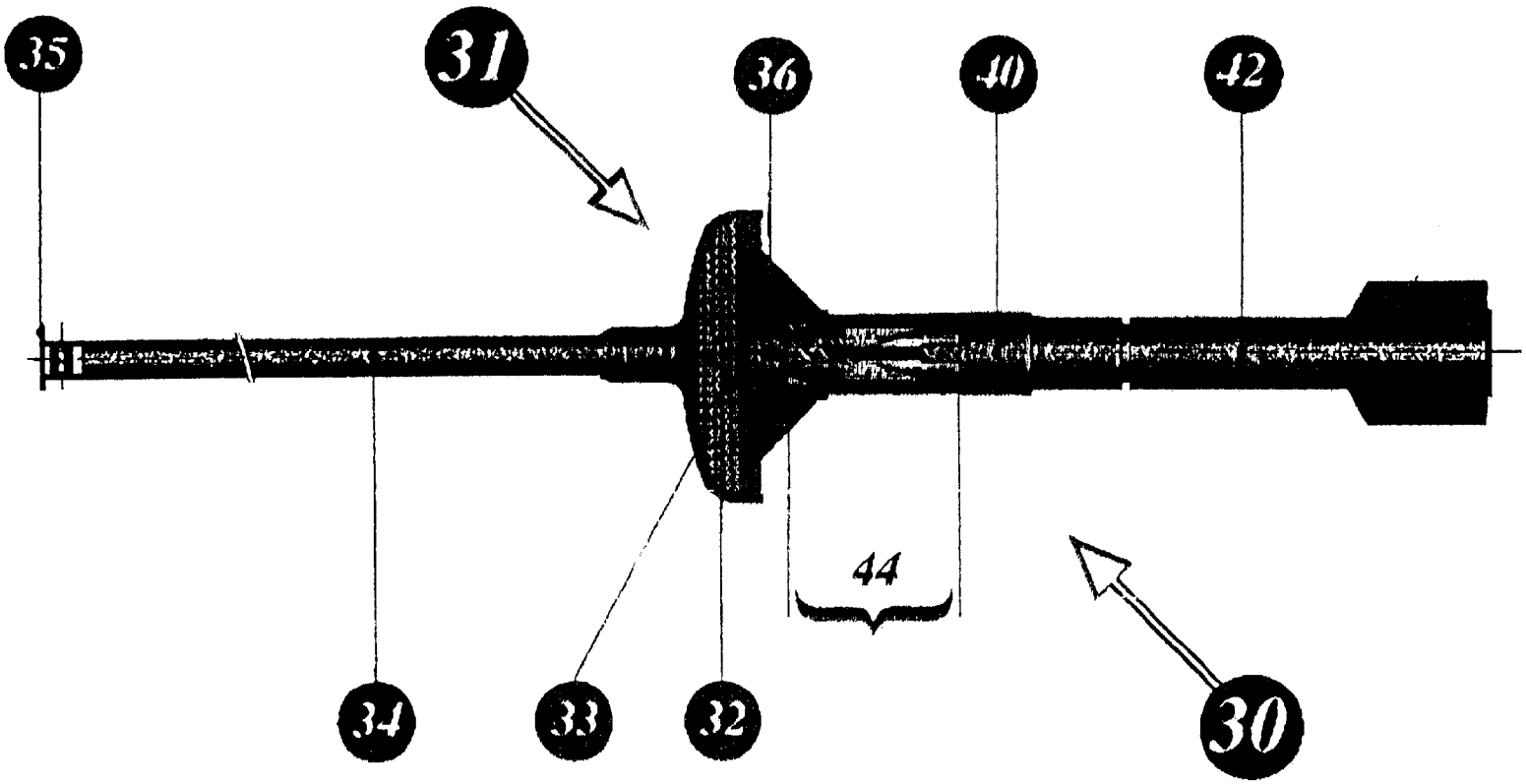

Fig.3 - SAFETY ADAPTER
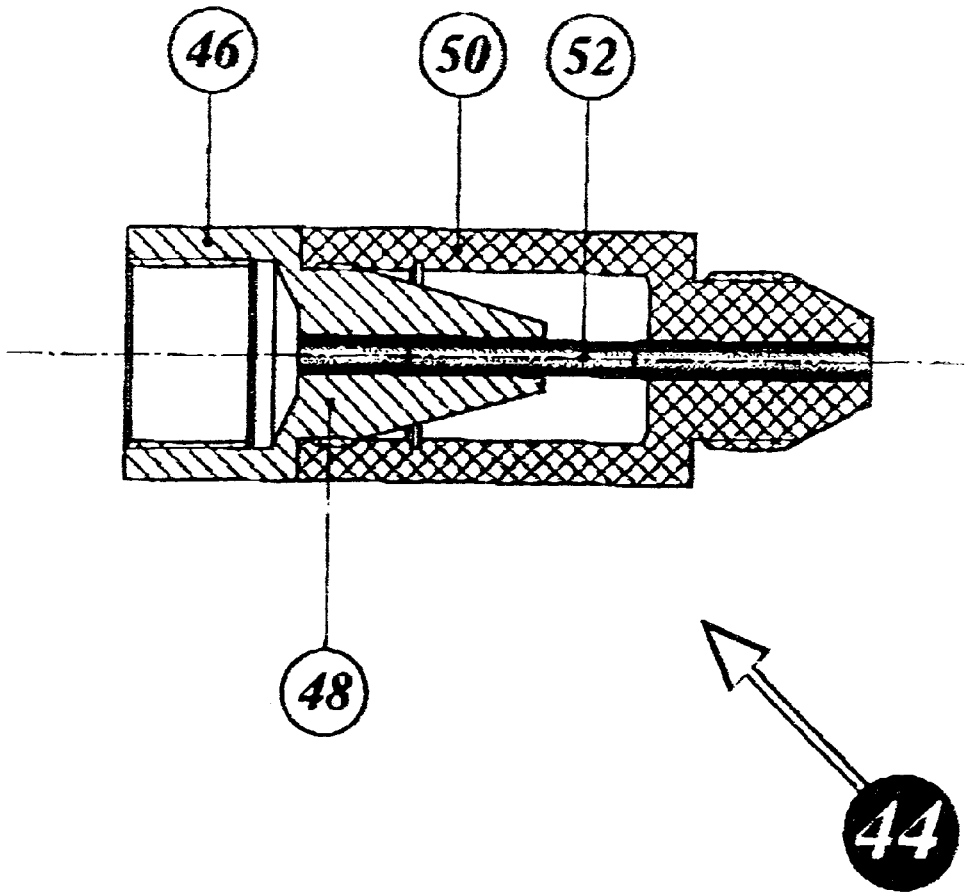

Fig.4 - ISOMETRIC SAFETY ADAPTER
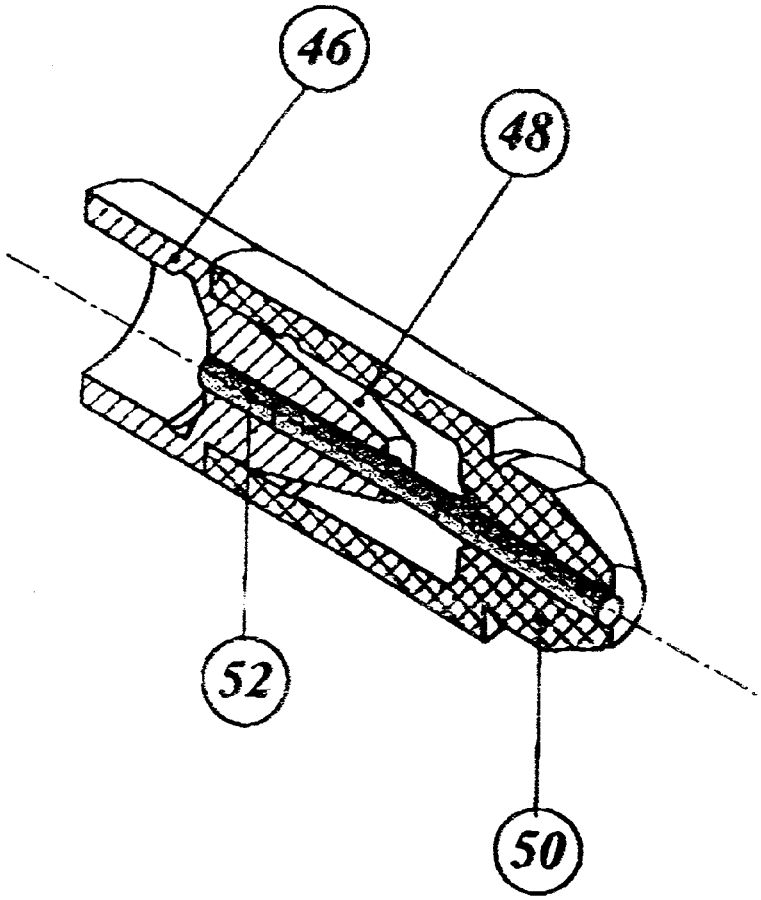

Fig.5 - BULLET TRAP FUSE
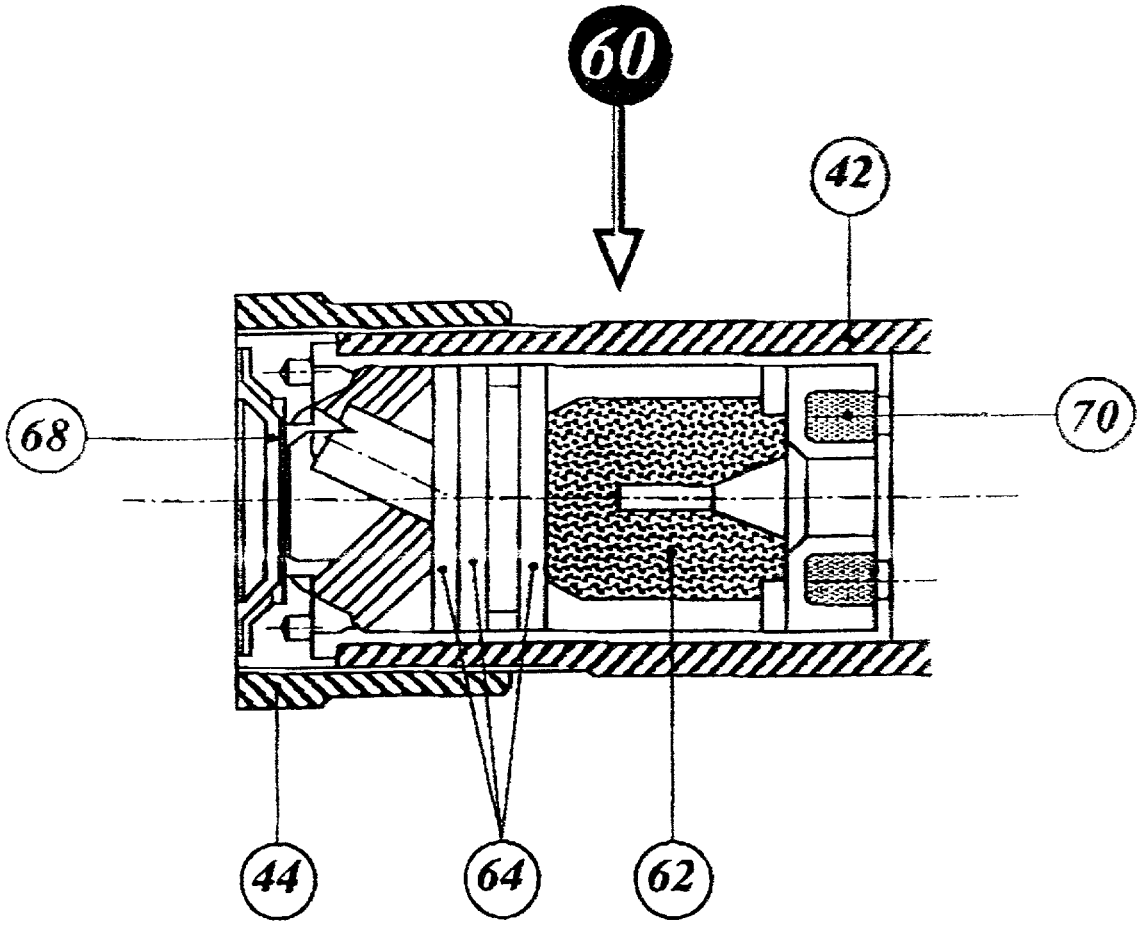

DOOR BREACHING DEVICE WITH SAFETY ADAPTER

FIELD AND BACKGROUND OF THE INVENTION

The present invention relates to devices for quickly removing a door and, more particularly, to devices for breaching a door so as to permit access through the doorway.

In various applications, both civilian and military, it is often desired to quickly remove a door so as to gain access to a certain doorway which would otherwise be blocked by the presence of a locked door. For example, drug enforcement personnel frequently need to gain rapid entry into a dwelling during a drug raid. The entry must be effected quickly in order to prevent the occupants from hiding or destroying the drugs, from escaping the premises or from seizing arms and violently resisting the efforts of the authorities. Similarly, in various circumstances, police and/or military forces must be able to gain quick access to a house or other structure protected by a door, typically locked, in order to seize, preferably alive, one or more wanted persons inside the premises and/or to free innocent hostages held inside the structure. In all these cases access must be gained in such a way that neither the persons attempting to gain access nor the persons located in the structure beyond the door to be removed are injured.

Israel Patent No. 106629 teaches a door breaching system intended for such applications which will now be described in some detail. The system includes a device, illustrated in cross section in FIG. 1, which has a stabilizer body 10 for stabilizing the device during its flight to the proper location, namely, into contact with the object, typically a door, to be removed. Stabilizer body 10 typically includes a tail or wings to aid in aerodynamically stabilizing the launched projectile. Stabilizer body 10 may be of any suitable type including, but not limited to, any of a wide variety of suitable conventional or known stabilizer bodies which can be used in conjunction with various launched grenades, mortars, and the like. The illustrative stabilizer body 10 depicted in FIG. 1 is similar to that commonly used to stabilizer anti-tank projectiles on their path toward a target.

The device further includes a shaped explosive charge 12, preferably including high explosive. Shaped explosive charge 12 is shaped to effectively breach the object, e.g., a door, without causing more than minimal damage to persons and property near and beyond the door, when explosive charge 12 is detonated at a preset distance from the door. Preferably, the anterior face of shaped explosive charge 12 is substantially spherical, but many other shapes may be effective, depending largely on the nature and dimensions of the object to be breached and on the distance from the object at which the explosion is to take place.

Shaped explosive charge 12 is located in a housing 14 designed to allow the force of the explosion to be directed anteriorly rather than posteriorly.

Housing 14 may be made of any suitable material, preferably, housing 14 is made of a suitable plastic so as to limit the formation of dangerous shrapnel and thereby minimize potential injuries to personnel on both sides of the door being blasted.

Connected to housing 14, or integrally formed with it, is a stand-off rod 16 of suitable length. Preferably, housing 14 and stand-off rod 16 are two discrete items which are readily connected to each other. Such an arrangement makes it easier to transport the disassembled device with rods 16, housings 14 containing shaped explosive charges 12 and stabilizer 10 housed separately for easy storage and rapid assembly. The connection of stand-off rod 16 to housing 14, when present, may be of any suitable type, including, but not limited to, by screwing or snap-fitting rod 16 into housing 14, and the like. Rod 16 may be made of any suitable material, including, but not limited to, plastic and metal.

The length of stand-off rod 16 and the type, amount and shape of shaped explosive charge 12 are selected to optimize the ability of the device to effectively remove the object, such as door, without injuring persons or other property in the vicinity.

Preferably, stand-off rod 16 has connected to its anterior end an impact disc 18 having an effective diameter larger than the effective diameter of standoff rod 16. Impact disc 18 may be integrally formed with stand-off rod 16. Preferably, impact disc 18 is disc-shaped. The presence of impact disc 18 is intended to enlarge the area of direct impact with the door so as to lower the pressure at the point of impact and thus reduce or eliminate the possibility of stand-off rod 16 penetrating the door, thereby reducing the effectiveness of the device and potentially injuring persons and damaging property located beyond the door.

Included in the device is a suitable detonating means for detonating shaped explosive charge 12 substantially upon impact of the anterior end of stand-off rod 18 with the object, e.g., the door.

The detonation can be effected in any of a number of ways, including, but not limited to, by transferring the impact from the stand off rod to a striker which initiates an initiator. The detonation is transferred to a lead pellet 20 which detonates explosive charge 12.

Preferably, the device also includes a "safe-and-arm" device (SAD) 22 of suitable design which prevents accidental or premature detonation of the device, as is commonly used in various current applications. SAD 22 may, for example, be selected to arm shaped explosive charge 12 only after a pre-selected time period has elapsed after the device has commenced to be propelled toward its target or after the device has been propelled through a pre-selected distance. SAD 22 may, for example, operate by bringing into alignment initiator and lead pellet 20 and shaped explosive charge 12 only after a certain period of time after launching of the device. Use of SAD 22 prevents the accidental detonation of the device but typically requires that the device be fired from beyond a certain minimum distance.

To use the device the operator connects a stand-off rod 16 to housing 14 of shaped explosive charge 12. The operator mounts stabilizer 10 onto a suitable launcher (not shown), such as a grenade launcher or suitable gun. Alternatively, stabilizer body 10 could be replaced by a self-propelling device (not shown), such as that used in RPG rockets. Preferably, however, the device is mounted onto a suitable launcher or gun which provides the propulsion required to deliver the explosive over the relatively short distance between the launcher and the objective. The operator aims at the optimal point on the object, such as a door, and fires the launcher, propelling the device toward its target.

Upon impact of the anterior end of stand-off rod 16 with the door, the initiator located in SAD 22 detonates pellet 20 (assuming SAD 22 was already armed) which, in turn, immediately sets off shaped explosive charge 12. The created explosion pressure waves spread in a way which depends on the nature, shape and quantity of the explosive used and on the distance from the target at the moment of explosion, which is determined largely by the length of stand-off rod 16.

The device of Israel Patent No. 106629 clearly has many advantages for rapid and relatively non-destructive knocking down of doors. However, given the short ranges over which it is typically used, the device poses a potential hazard to the device operator and other personnel in his proximity. Specifically, there is a risk that part or all of stabilizer body 10 may be propelled rearwards at high speed by the force of the explosion, thereby injuring personnel.

There is thus a need for, and it would be highly advantageous to have, a device generally similar to the device described above for quickly and effectively breaking down a locked door which will not pose a safety hazard to the operator and other personnel in his vicinity.

SUMMARY OF THE INVENTION

The present invention is a door breaching device which includes a safety adapter.

According to the teachings of the present invention there is provided, a breaching device for controlled blasting of an object at short range, the device comprising: (a) a blasting element including an explosive charge contained within a housing, the blasting element being configured to blast the object from a preset distance; (b) a stand-off rod connected to, and extending from, the housing, the stand-off rod having a length equal to the preset distance; (c) a pyrotechnic lead pellet associated with the blasting element and with the standoff rod so as to detonate the explosive charge substantially upon impact of the stand-off rod with the object; and (d) a tail for stabilizing the device during its flight to the object, wherein the tail is connected to the blasting element through a safety connector, the safety connector being configured to reduce shock forces acting on the tail resulting from detonation of the explosive charge.

According to a further feature of the present invention, the safety connector includes: (a) a male portion attached to, or integrally formed with, the tail, the male portion having a substantially conical outer surface; and (b) a female portion attached to, or integrally formed with, the blasting element for receiving the male portion.

According to a further feature of the present invention, the male portion is made from a first material and the female portion is made from a second material softer than the first material, preferably, a polymer material. The first material is preferably metallic.

According to a further feature of the present invention, the safety connector further includes a detonating cord extending through both the male portion and the female portion.

According to a further feature of the present invention, the detonating cord extends through a bore located axially within the male portion.

According to a further feature of the present invention, the tail and the blasting element are configured to be directly connectable, and the safety connector is implemented as an adapter configured to be interposed between the tail and the blasting element.

According to a further feature of the present invention, the tail includes a bullet trap and is configured to permit launching of the breaching device from a rifle.

There is also provided according to the teachings of the present invention, a safety connector for connecting a tail to a warhead and configured to minimize backfire of the tail on detonation of the warhead, the connector comprising: (a) a male portion attached to, or integrally formed with, the tail, the male portion having a substantially conical outer surface; and (b) a female portion attached to, or integrally formed with, the warhead for receiving the male portion.

According to a further feature of the present invention, the male portion and the female portion are implemented as a pre-formed adapter configured to be interposed between the tail and the warhead.

There is also provided according to the teachings of the present invention, a method for minimizing backfire of a tail connected to a warhead on detonation of the warhead, the method comprising interposing between the tail and the warhead a safety adapter configured to reduce shock forces acting on the tail resulting from detonation of the warhead.

BRIEF DESCRIPTION OF THE DRAWINGS

The invention is herein described, by way of example only, with reference to the accompanying drawings, wherein:

FIG. 1 is a cross-sectional view through a prior breaching device;

FIG. 2 is a cross-sectional view through a breaching device constructed and operative according to the teachings of the present invention including a safety connector;

FIG. 3 is an enlarged cross-sectional view of the safety connector of FIG. 2;

FIG. 4 is a cut-away isometric view of the safety connector of FIG. 2; and FIG. 5 is a cross-sectional view of a bullet trap for use in the breaching device of FIG. 2.

DESCRIPTION OF THE PREFERRED EMBODIMENTS

The present invention is of a door breaching device which can effectively be used to remotely blow away doors with minimal or no damage to the operator or to persons and property near and beyond the door.

The principles and operation of a device according to the present invention may be better understood with reference to the drawings and the accompanying description.

Turning now to the drawings, FIG. 2 shows a breaching device, generally designated 30, constructed and operative according to the teachings of the present invention, for controlled blasting of an object at short range.

Generally speaking, breaching device 30 is similar to the device of Israel Patent No. 106629 described above. Thus, breaching device 30 includes a blasting element 31 including an explosive charge 32 contained within a housing 33. Blasting element 31 is configured to breach the door or other object from a preset distance. Connected to, and extending from, housing 33 is a stand-off rod 34 having a length equal to the preset distance. Typically, standoff rod 34 is connected at its anterior end to an impact disc 35 which has an effective diameter larger than the effective diameter of stand-off rod 34.

Preferably, the device includes a suitable SAD 40 which prevents accidental or premature detonation of the device, as is commonly used in various known applications. SAD 40 may, for example, be selected to arm shaped explosive charge 32 only after a pre-selected time period has elapsed after the device has commenced to be propelled toward its target or after the device has been propelled through a pre-selected distance.

A detonator located inside SAD 40 is associated with blasting element 31 and stand-off rod 34 so as to detonate explosive charge 32 substantially upon impact of stand-off rod 34 with the object. Housing 33 preferably contains a lead pellet 36 which transfers the detonation from SAD 40 to explosive charge 32. A tail 42 stabilizes device 30 during its flight to the object.

It is a particular feature of the present invention that tail 42 is connected to blasting element 31 through a safety connector 44 configured to reduce shock forces acting on tail 42 resulting from detonation of explosive charge 32. This serves to minimize the risk of tail 42, or any part thereof, being propelled rearwards in a manner that could cause injury to the operator or other personnel in his vicinity.

Details of a preferred implementation of safety connector 44 are shown in FIGS. 3 and 4. In this case, safety connector 44 includes a male portion 46 attached to, or integrally formed with, tail 42. Male portion 46 features a substantially conical outer surface 48 which deflects a major part of the rearward detonation pressure wave outwards so that it is ineffective at propelling tail 42 rearwards. The other part of the connection is provided by a female portion 50 attached to, or integrally formed with, blasting element 31 and configured for receiving male portion 46. Connection between male portion 46 and female portion 50 is preferably through complementary threaded portions towards the outer periphery of conical outer surface 48.

Preferably, male portion 46 is made from a material significantly harder than that used for female portion 50. This ensures that the detonation pressure wave destroys female portion 50 while leaving conical outer surface 48 intact to deflect the blast. Preferred materials for male portion 46 include, but are not limited to, metallic materials (metals and metal alloys) and especially lightweight structural materials such as aluminum. Female portion 50 is preferably made from polymer materials such as various types of plastics.

Preferably, safety connector 44 includes a detonating cord 52 which transfers the detonation from the detonator to lead pellet 36 and then to explosive charge 32. Detonating cord 52 preferably extends through both male portion 46 and female portion 50. A preferred location for detonating cord 52, as illustrated here, extends through a bore located axially within male portion 46. The use of a detonating cord is preferred over alternatives such as booster charges since it avoids damage to male portion 46 which could disrupt conical outer surface 48.

Finally with regard to safety connector 44, it should be noted that the connector may be implemented integrally with one or both of SAD 40 and blasting element 31. However, in a preferred implementation, safety connector 44 is implemented as a preformed adapter configured to be located between SAD 40 and blasting element 31. In the case shown here, male portion 46 is formed with an internal threaded portion while female portion 50 is formed with a corresponding external threaded portion. This allows the adapter to be interposed between SAD and blasting element components configured for direct connection.

Turning now to FIG. 5, a further preferred feature of breaching device 30 is that it may be launched from a standard rifle. To this end, tail 42 preferably features a bullet trap 60 which serves to safely contain a live bullet fired from the rifle while transferring the bullet's momentum to breaching device 30. In the preferred implementation shown here, bullet trap 60 includes a primary trap 62 and a number of steel disks 64 to halt the bullet, as well as a bullet diverter 66 as an additional safeguard against the bullet impinging directly upon the explosive charge 32. A black powder charge 70, or any other suitable gun powder or propellant, is positioned in front of trap 62 so as to be ignited by the hot muzzle gases from the rifle barrel, thereby enhancing propulsion of the device. The forward movement of components of bullet trap 60 deforms diaphragms 68 which initiates the SAD arming process.

It will be appreciated that the safety connector of the present invention is not limited to the specific application of the breaching device described above but may equally be used for connecting a SAD to a warhead in a range of other applications. The present invention also provides a corresponding method for minimizing backfire of a tail connected to a warhead on detonation of the warhead in a wide range of applications.

It will be appreciated that the above descriptions are intended only to serve as examples, and that many other embodiments are possible within the spirit and the scope of the present invention.

What is claimed is:

1. A breaching device for controlled blasting of an object at short range, the device comprising:

(a) a blasting element including an explosive charge contained within a housing, said blasting element being configured to blast the object from a preset distance;

(b) a stand-off rod connected to, and extending from, said housing, said stand-off rod having a length equal to said preset distance;

(c) a pyrotechnic lead pellet associated with said blasting element and with said stand-off rod so as to detonate said explosive charge substantially upon impact of said stand-off rod with the object; and (d) a tail for stabilizing the device during its flight to the object, wherein said tail is connected to said blasting element through a safety connector, said safety connector being configured to reduce shock forces acting on said tail resulting from detonation of said explosive charge.

2. The breaching device of claim 1, wherein said safety connector includes:

(a) a male portion attached to, or integrally formed with, said tail, said male portion having a substantially conical outer surface; and (b) a female portion attached to, or integrally formed with, said blasting element for receiving said male portion.

3. The breaching device of claim 2, wherein said male portion is made from a first material and wherein said female portion is made from a second material softer than said first material.

4. The breaching device of claim 3, wherein said second material is a polymer material.

5. The breaching device of claim 4, wherein said first material is a metallic material.

6. The breaching device of claim 2, wherein said safety connector further includes a detonating cord extending through both said male portion and said female portion.

7. The breaching device of claim 6, wherein said detonating cord extends through a bore located axially within said male portion.

8. The breaching device of claim 2, wherein said tail and said blasting element are configured to be directly connectable, and wherein said safety connector is implemented as an adapter configured to be interposed between said tail and said blasting element.

9. The breaching device of claim 1, wherein said tail includes a bullet trap and is configured to permit launching of the breaching device from a rifle.

10. A safety connector for connecting a tail to a warhead and configured to minimize backfire of the tail on detonation of the warhead, the connector comprising:

(a) a male portion attached to, or integrally formed with, the tail, said male portion having a substantially conical outer surface; and (b) a female portion attached to, or integrally formed with, the warhead for receiving said male portion, wherein said male portion is made from a first material and wherein said female portion is made from a second material softer than said first material.

11. The safety connector of claim 10, wherein said second material is a polymer material.

12. The safety connector of claim 11, wherein said first material is a metallic material.

13. The safety connector of claim 10, further comprising a detonating cord running through both said male portion and said female portion.

14. The safety connector of claim 13, wherein said detonating cord extends through a bore located axially within said male portion.

15. The safety connector of claim 10, wherein said male portion and said female portion are implemented as a preformed adapter configured to be interposed between the tail and the warhead.

16. A method for minimizing backfire of a tail connected to a warhead on detonation of the warhead, the method comprising interposing between the tail and the warhead a safety adapter configured to reduce shock forces acting on the tail resulting from detonation of the warhead.

* * * * *